US005795185A

United States Patent [19]

Edgley et al.

[11] Patent Number: 5,795,185

[45] Date of Patent: Aug. 18, 1998

[54] ELECTRICAL CONNECTOR FOR MOUNTING ON A SUPPORT STRUCTURE SUCH AS A PANEL OR THE LIKE

[75] Inventors: Richard R. Edgley, Elmhurst, Ill.; William R. Lenz, Grand Marais, Minn.; John S. Luthy, Naperville; Karen Samiec, Downers Grove, both of Ill.

[73] Assignee: Molex Incorporated, Lisle, Ill.

[21] Appl. No.: 801,235

[22] Filed: Feb. 19, 1997

[51] Int. Cl.[6] ..... H01R 13/74

[52] U.S. Cl. ..... 439/545

[58] Field of Search ..... 439/545, 544, 439/557, 549, 558

[56] References Cited

U.S. PATENT DOCUMENTS

| | | | |
|---|---|---|---|
| 3,850,497 | 11/1974 | Krumreich et al. | 439/545 |
| 4,077,693 | 3/1978 | Briel, Jr. et al. | 339/126 R |
| 4,556,190 | 12/1985 | Smith | 249/99 |
| 4,647,129 | 3/1987 | Kandybowski | 339/64 M |
| 4,921,435 | 5/1990 | Kane et al. | 439/248 |
| 5,127,852 | 7/1992 | Cravens et al. | 439/545 |
| 5,205,759 | 4/1993 | Haderer | 439/545 |

FOREIGN PATENT DOCUMENTS

| | | | |
|---|---|---|---|
| 5-275868 | 10/1993 | Japan | H05K 7/12 |
| 7-245151 | 9/1995 | Japan | H01R 13/631 |

*Primary Examiner*—Neil Abrams
*Assistant Examiner*—Tho D. Ta
*Attorney, Agent, or Firm*—Stephen Z. Weiss

[57] ABSTRACT

An electrical connector for mounting in a cutout in a generally planar panel. The connector includes a dielectric housing having guide projections on the side of the housing for slidably mounting the housing in the cutout in an insertion direction generally parallel to the plane of the panel. At least one latch projection on the housing extends therefrom in the insertion direction generally parallel to the plane of the panel for engaging an appropriate lock projecting from the panel.

11 Claims, 3 Drawing Sheets

ELECTRICAL CONNECTOR FOR MOUNTING ON A SUPPORT STRUCTURE SUCH AS A PANEL OR THE LIKE

FIELD OF THE INVENTION

This invention generally relates to the art of electrical connectors and, particularly, to an electrical connector for mounting to a panel, such as in a cutout in an edge of the panel.

BACKGROUND OF THE INVENTION

Very generally, electrical connectors are used to interconnect two electrical apparatus, one or both of the apparatus being such items as electrical cables, printed circuit boards or the like. Typically, a pair of electrical connectors simply include a pair of mating dielectric housings respectively mounting mating terminals which are terminated to the conductors of the electrical cable, printed circuit board or the like. For instance, mating plug and receptacle connector housings may mount interconnectable male and female terminals.

In many applications, one or both of a pair of mating connectors are mounted in or on a support structure, such as a generally planar panel. It often is necessary to secure the connector housing to the support structure. This can be accomplished by fasteners such as bolts, screws, separate clips or the like. In order to avoid the costs involved in the manufacture and use of separate fasteners, it is known to provide complementary interengaging fastening means between the connector housing and the support structure or panel. For instance, the connector housing may be molded with one or more latch bosses which automatically snap into latch holes or recesses in the support structure or panel to secure the connector housing to the panel. Unfortunately, such integral latch means often are unreliable, cumbersome and require additional space projecting outwardly from the lateral sides of the connector housing.

The present invention is directed to solving the problem of securing connectors to support structures or panels with a simple and effective integral latching system which operates in the direction of insertion of the connector into a cutout in a panel.

SUMMARY OF THE INVENTION

An object, therefore, of the invention is to provide a new and improved electrical connector for mounting in a cutout in an edge of a generally planar panel.

Another object of the invention is to provide a system for mounting an electrical connector on a panel structure.

In the exemplary embodiment of the invention, an electrical connector includes a dielectric housing having guide projections on the side of the housing for slidably mounting the housing in a cutout in an edge of a generally planar panel. The housing is mounted in the cutout in an insertion direction generally parallel to the plane of the panel. At least one latch projection extends from the housing in the insertion direction generally parallel to the plane of the panel for engaging an appropriate locking means projecting perpendicular from the panel. Therefore, latch projections are not required to extend laterally outwardly of the housing.

As disclosed herein, the latch projection is provided in the form of a flexible latch arm cantilevered from the housing. The latch arm includes a latch hook near a distal end of the arm. Preferably, a pair of the flexible latch arms extend generally parallel to each other away from the housing.

In the system of the invention, a panel structure includes the generally planar panel having the cutout in the edge thereof, and also includes a section of the panel structure projecting generally perpendicular to the generally planar panel. The perpendicular section of the panel structure locking means comprises a panel portion having an opening therein through which the housing moves when the housing is mounted in the cutout in the planar panel. The latch hooks on the latch arms engage the edge of the opening in the perpendicular panel portion.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
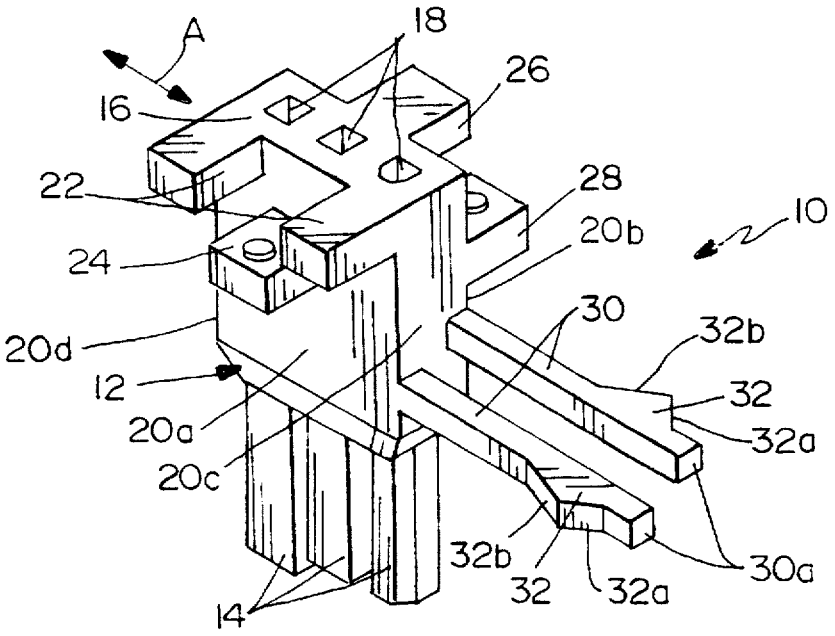
FIG. 1 is a perspective view of an electrical connector embodying the concepts of the invention.
Figure 2:
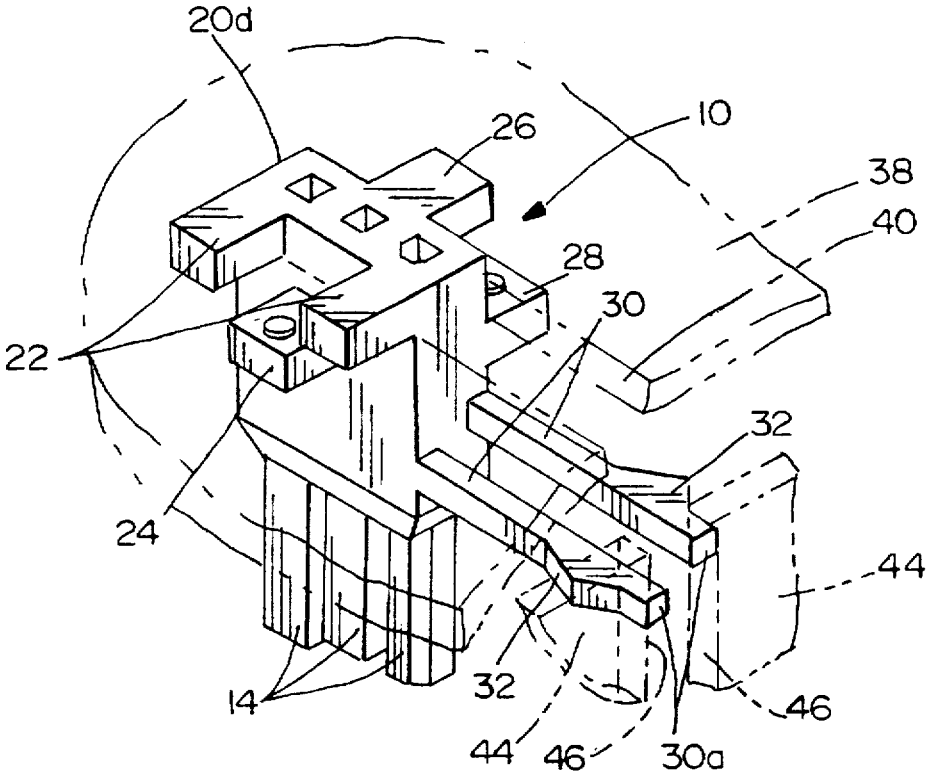
FIG. 2 is a perspective view of the connector mounted in a panel structure.
Figure 6:
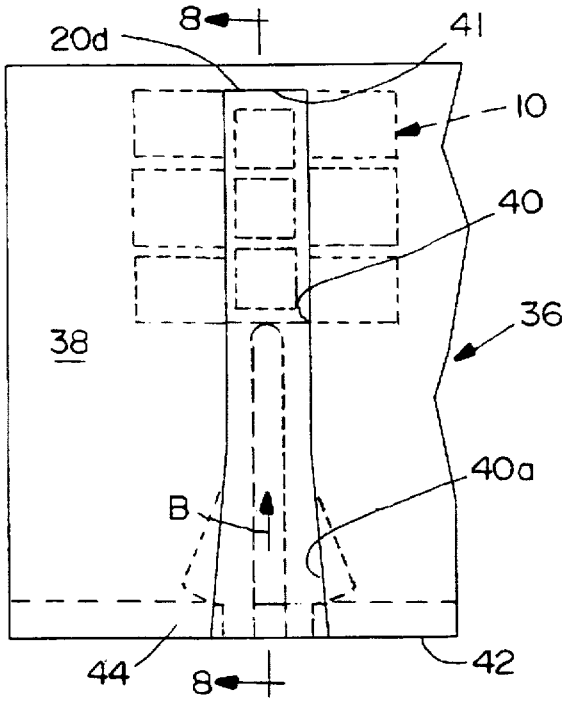
FIG. 6 is a top plan view of a panel structure having a generally planar panel with a cutout in an edge thereof.
Figure 7:
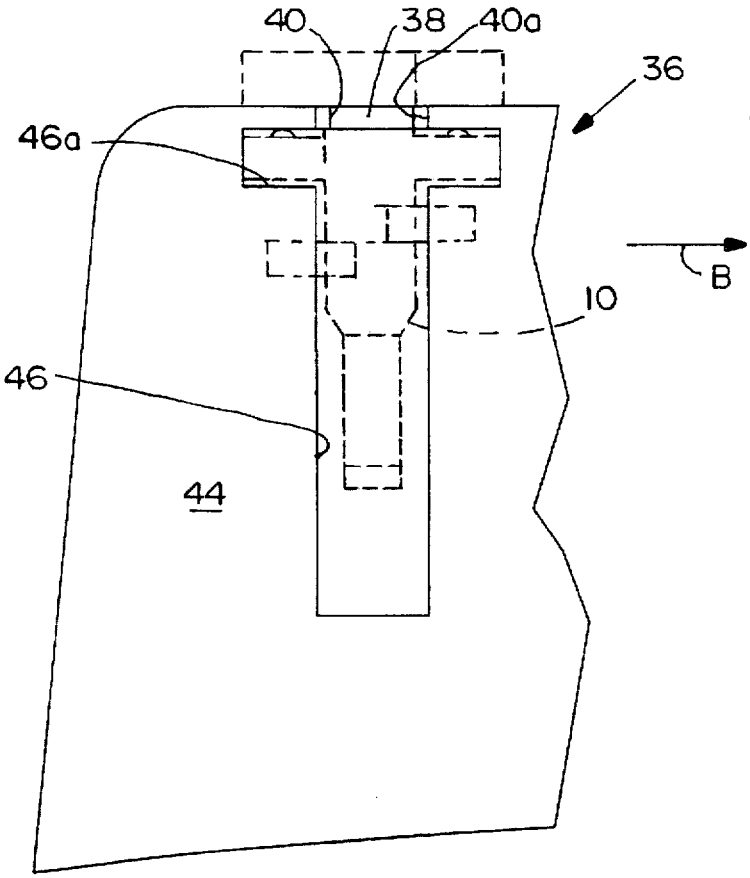
FIG. 7 is a front elevational view of the panel structure, looking toward the front of FIG. 6.
Figure 8:
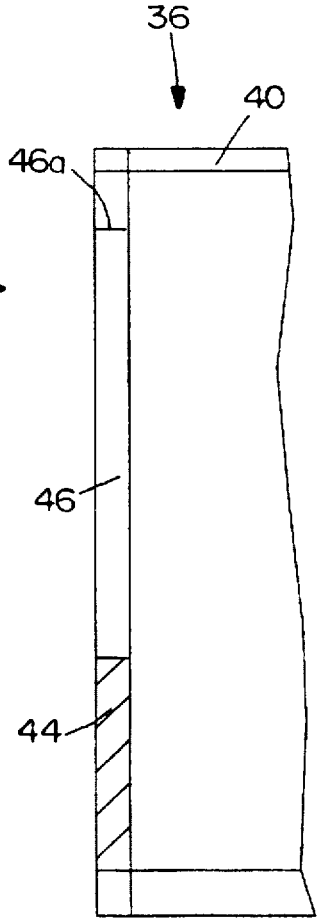
FIG. 8 is a vertical section taken generally along line 8—8 of FIG. 6.

Referring to the drawings in greater detail, FIGS. 1 and 3–5 show the electrical connector of the invention, FIG. 2 shows the connector mounted in a panel structure according to system of the invention and FIGS. 6–8 show details of the panel structure.

Referring first to FIGS. 1 and 3–5, the invention contemplates an electrical connector, generally designated 10, which includes a one-piece dielectric housing, generally designated 12. The housing is unitarily molded of dielectric material such as plastic or the like. The housing includes a mating end defined by three forwardly extending silos 14 and a rear, generally flat terminating end 16 having three openings 18. In essence, silos 14 define the mating end of the connector and are adapted for insertion into appropriate receptacles of a complementary mating connector (not shown). Openings 18 in flat terminating end 16 of the connector define the rear openings of passages (not shown) extending lengthwise through housing 12 and into silos 14. The passages mount three terminals (not visible in the drawings) which are terminated to electrical wires projecting outwardly of the housing through openings 18 in flat terminating end 16 of the housing.

Generally, guide means are provided on connector housing 12 for slidably mounting the housing in a cutout in an edge of a generally planar panel, as described hereinafter.

Figure 4:
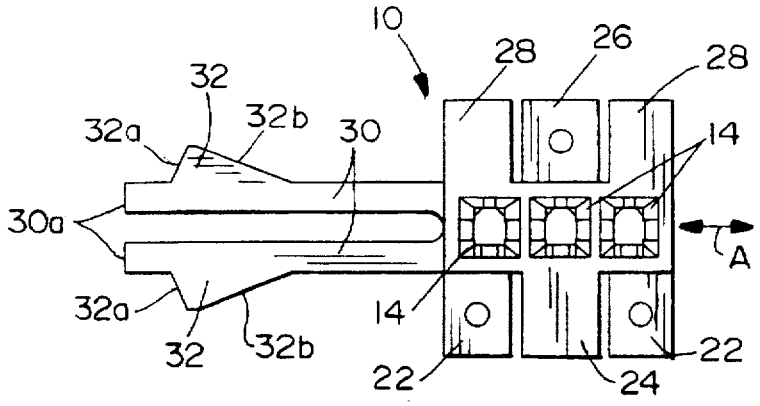
FIG. 4 is a bottom plan view of the connector.
Figure 5:
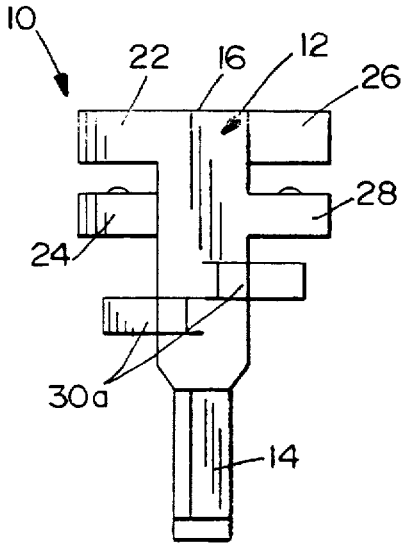
FIG. 5 is a side elevational view of the connector, looking toward the left-hand side of FIG. 3.
Figure 3:
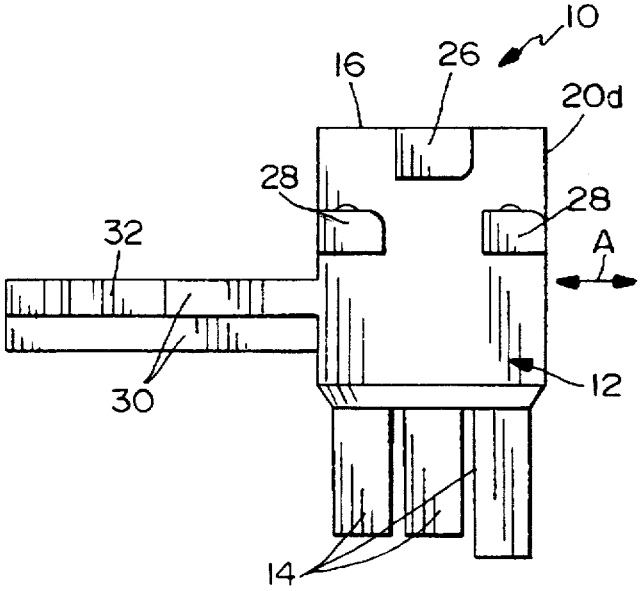
FIG. 3 is a side elevational view of the connector.

More particularly, the housing is inserted into and removed from the panel cutout in the direction of double-headed arrows "A" (FIGS. 1, 3 and 4). This may be referred to hereinafter and in the claims hereof as the insertion direction of the connector, i.e. generally parallel to the planar panel. Housing 12 has opposite sides 20*a* and 20*b* extending generally parallel to arrow "A" and leading side 20*d*. A pair of top guide projections 22 and a single bottom guide projection 24 project outwardly from side 20*a* of housing 12. Bottom guide projection 24 is spaced from top guide projections 22 in a direction perpendicular to arrow "A" a distance at least equal to the thickness of the planar panel to which the connector is mounted. Somewhat similarly, a single top guide projection 26 and a pair of bottom guide projections 28 project outwardly from side 20*b* of housing 12. Bottom guide projections 28 are spaced from top guide projection 26 perpendicular to arrow "A" a distance at least equal to the thickness of the planar panel.

Generally, latch projections are provided on connector housing 12 extending therefrom in the insertion/removal direction as indicated by double-headed arrows "A", i.e. generally parallel to the plane of the panel. More particularly, a pair of flexible latch arms 30 are cantilevered from a side 20*c* of connector housing 12. The latch arms have latch hooks 32 near distal ends 30*a* of the latch arms. The latch hooks have latch shoulders 32*a* spaced inwardly from distal ends 30*a* of the arms. When connector housing 12 is inserted into a cutout in a panel, side 20*c* of the connector housing could be considered the trailing side of the housing and, therefore, cantilevered latch arms 30 would project rearwardly of the housing as it is inserted into the panel cutout.

FIG. 2 shows electrical connector 10 mounted in a panel structure, generally designated 36 which includes generally planar panel and locking means 44. More particularly, referring to FIGS. 6–8 in conjunction with FIG. 2, panel 38 includes a cutout 40 (FIG. 6) with base 41 in an edge 42 of the panel. It can be seen that the mouth of cutout 40 communicating with edge 42 is flared, as at 40*a*, to facilitate guiding the connector housing into the cutout. Also, when fully inserted into the cutout 40 the leading side 20*d* of the housing 12 will contact the base 41 preventing the housing from sliding further into the cut out 40.

Locking means includes a section or panel portion 44 (FIG. 7) which extends or projects generally perpendicular to planar panel 38. Panel portion 44 includes a T-shaped opening 46 having a cross portion 46*a* defining the top of the T-shape. Opening 46 in panel portion 44 is aligned with cutout 40 in planar panel 38, and the cross portion 46*a* of the opening communicates with mouth 40*a* of the cutout. This can be seen clearly in FIG. 8. Connector housing 12 is mounted to panel structure 36 in the direction of arrows "B" (FIGS. 6 and 8).

In mounting connector 10 (i.e. housing 12) to the panel structure 36, a leading side 20*d* of the housing is inserted into mouth 40*a* of cutout 40 in planar panel 38 of the panel structure. During insertion, edge 42 of planar panel 38 is guided into the spacing between top and bottom guide projections 22 and 24, respectively, on side 20*a* of the housing and between top and bottom guide projections 26 and 28, respectively, on side 20*d* of the housing. The housing is inserted until the leading side 20*d* of the housing bottoms out at the base 41 of cutout 40.

During insertion of connector housing 12 into cutout 40 in planar panel 38, insertion end 14 of the housing moves through opening 46 in panel portion 44 of the panel structure, as bottom guide projections 24 and 28 on opposite sides 20*a* and 20*b*, respectively, of the housing move through cross portion 46*a* of the opening. In essence, top guide projections 22 and 26 slide along the top of planar panel 38, while bottom guide projections 24 and 28 slide beneath the bottom of planar panel 38.

When connector housing 12 is fully seated into cutout 40 in planar panel 38, latch shoulders 32*a* of latch hooks 32 on cantilevered latch projections or arms 30 snap behind the inner surface of locking means or panel portion 44. During insertion of the connector housing, angled surfaces 32*b* at the leading ends of latch bosses 32 engage the sides of opening 46 in panel portion 44 to bias flexible latch arms 30 inwardly toward each other so that the latch bosses pass through the opening. When the connector housing is fully inserted, latch shoulders 32*a* clear opening 46 and allow flexible latch arms 30 to snap back outwardly to automatically secure the connector in the panel structure as latch shoulders 32*a* abut against the inner or back side of panel portion 44 on opposite sides of opening 46.

In order to remove connector 10 from panel structure 36, distal ends 30*a* are grasped, as by an operator's fingers, and moved inwardly toward each other so that latch bosses 32 and latch shoulders 32*a* are located inside the opposite edges of opening 46. The connector then can be pulled out of cutout 40 in planar panel 38 of the panel structure.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for mounting in a cutout in an edge of a first generally planar panel and for mounting through an opening in a second generally planar panel perpendicular to the first generally planar panel, comprising:

a dielectric housing including guide projections on the side of the housing for slidably mounting the housing in the cutout in an insertion direction generally parallel to the plane of the first panel;

at least one latch projection on the housing extending therefrom in said insertion direction generally parallel to the plane of the first panel for engaging an appropriate locking means projecting from the generally second planar panel, and the housing and at least said latch projection on the housing adapted to pass through said opening prior to mounting.

2. The electrical connector of claim 1 wherein said latch projection comprises a flexible latch arm cantilevered from the housing.

3. The electrical connector of claim 2 wherein said latch arm includes a latch hook near a distal end of the arm.

4. The electrical connector of claim 2, including a pair of said flexible latch arms extending generally parallel to each other away from the housing.

5. The electrical connector of claim 4 wherein said latch arms include latch hooks near distal ends of the arms.

6. A system for mounting an electrical connector on a planar panel structure, comprising:

a first generally planar panel having a cutout in an edge thereof;

a second generally planar panel comprising a locking means projecting from and generally perpendicular to said first panel;

said connector including a housing having guide portions for slidably mounting the housing in the cutout in an insertion direction generally parallel to the plane of the first panel, and at least one latch projection on the housing extending therefrom in said insertion direction generally parallel to the plane of the first panel for engaging said locking means, and wherein said second panel having an opening therein through which the housing and at least said latch projection on the housing move when the housing is mounted in said cut out.

7. The system of claim 6 wherein said latch portion comprises a flexible latch arm cantilevered from the housing.

8. The system of claim 7 wherein said latch arm includes a latch hook near a distal end of the arm for engaging an edge of the opening in said second generally planar panel.

9. The system of claim 8, including a pair of said flexible latch arms extending generally parallel to each other away from the housing.

10. The system of claim 9 wherein said latch arms include latch hooks near distal ends of the arms.

11. The system of claim 10 wherein said distal ends of the latch arms project through the opening in said locking means extending beyond the second planar panel a distance for allowing manual grasping thereof to move the flexible latch arms toward each other and allow removal of the connector from the panel structure.

* * * * *